US005437432A

United States Patent [19]

Fujikawa

[11] Patent Number: 5,437,432

[45] Date of Patent: Aug. 1, 1995

[54] HOIST MACHINE

[75] Inventor: Masaru Fujikawa, Sayama, Japan

[73] Assignee: Elephant Chain Block Company Limited, Osaka, Japan

[21] Appl. No.: 46,951

[22] Filed: Apr. 16, 1993

[30] Foreign Application Priority Data

Jun. 15, 1992 [JP] Japan ..... 4-155246

[51] Int. Cl.[6] ..... B66D 1/54

[52] U.S. Cl. ..... 254/362; 318/753

[58] Field of Search ..... 254/362, 267, 372; 318/739, 753

[56] References Cited

U.S. PATENT DOCUMENTS 2,683,844 7/1954 Schaefer .
3,575,562 4/1971 Remke .
3,971,971 7/1976 Wycoff .
4,353,022 10/1982 Young .
4,422,029 12/1983 Deniers et al. .
4,636,962 1/1987 Broyden ..... 254/362 X
4,665,286 5/1987 Hansen .
4,789,135 12/1988 Watanabe ..... 254/362
4,792,734 12/1988 Watanabe ..... 254/362 X
4,917,360 4/1990 Kojima ..... 254/362
5,139,156 8/1992 Nakamura ..... 254/362

*Primary Examiner*—Daniel P. Stodola
*Attorney, Agent, or Firm*—Stevens, Davis, Miller & Mosher

[57] ABSTRACT

A hoist machine provided with a driving member driven by a capacitor start single phase motor, which is provided with a governor and a switching device for turning a start capacitor on and off following operation of the governor. The switching device is provided with a switch control panel, which, when the driving member drives to hoist a load, maintains on-operation of the lowering side switch and turns off the hoisting side switch following the operation of the governor to thereby cut off energization to the start capacitor, and when in a lowering operation, maintains on-operation of the hoisting side switch and turns off the lowering side switch to thereby cut off energization of the start capacitor.

6 Claims, 6 Drawing Sheets

HOIST MACHINE

FIELD OF THE INVENTION

The present invention relates to a hoist machine which uses a capacitor start single phase motor having a start capacitor so as to hoist or lower a load such as baggage.

BACKGROUND OF THE INVENTION

A conventional hoist machine using a capacitor start single phase motor is provided at a driving shaft interlocking the motor with a governor operating in response to the rotation speed of the driving shaft and a governor switch turned on and off by operation of the governor. The governor switch is interposed in an auxiliary switching circuit to which the start capacitor is connected, so that when the motor is intended to stop its operation, the governor switch is turned on, and, when intended to start, the start capacitor is operated to start, the motor, and after start thereof the governor switch is turned off, thereby cutting off energization to the start capacitor.

In other words, since the single phase motor has a small starting torque, generally the start capacitor is used so as to start the motor in a capacitor start system. In a case where the start capacitor is used, when energization continues even after start, a current several times larger than a current value of the motor flows in the start capacitor to cause heating thereof, whereby the governor is used which operates following the rotation of the driving shaft driven by the motor. Hence, the governor switch operated by the governor is turned off so that, after starting the motor, energization to the start capacitor is cut off to thereby solve the problem of heating.

A hoist machine, such as a chain block or a trolley, which is used for hoisting or lowering a load to be hoisted, such as a baggage, a shutter of an electric shutter or a pallet at a two story motor pool, may often cause the motor to be changed from the lowering drive to the hoisting drive due to a hoist command given halfway of driving the motor for lowering the load under a lowering command.

In other words, for example, during the unloading a baggage, in of case that the unloading position is lower than the target position, for example, a push button switch of the hoist machine is depressed to give a hoist command so as to hoist the load onto the target position.

However, when the hoist command is given in the state where the motor, as above-mentioned, operates to lower the load, the motor may not operate in the hoisting direction, but continue the lowering operation regardless of the hoist command.

In other words, in the case where the motor is loaded in the lowering direction, even when the hoist command is given halfway through the lowering operation, the motor continues its rotation in the lowering direction because of inertia of the motor.

In this case, however, the governor operates to keep the governor switch off so as not to actuate the start capacitor.

Accordingly, even when the motor is given the hoist command and a normal and reverse rotation switching circuit is switched thereby, a starting torque is not applied to the hoisting side, whereby the motor is not quickly switched to rotation in the hoisting direction.

SUMMARY OF THE INVENTION

An object of the present invention is to provide a hoist machine which, even when a hoist command is given during the lowering operation, can immediately operate a start capacitor to perform a quick hoisting operation.

In order to attain the above-mentioned object, the present invention is characterized by providing a capacitor start single phase motor 3 having a start capacitor C1 and a normal and reverse rotation switching circuit 19 for switching the rotation direction in the normal or reverse rotation direction under an external command, a driving member 2 which is driven by the motor 3 in the normal or reverse rotation direction so as to hoist or lower a load to be hoisted, a governor 4 operable in response to the drive and stop operation of the motor 3,and a switching device 5 to turn on-off the start capacitor C1 following the operation of governor 4, the switching device 5 being provided with a switch 33 at the hoisting side which comprises a first contact arm 31 at the hoisting side connected to a line **19*a* at the hoisting side of the switching circuit 19 and a second contact arm 32 at the hoisting side connected to the start capacitor C1 and being normally on a switch 36 at the lowering side which comprises a first contact arm 34 connected to a line 19*b* at the lowering side of the switching circuit 19 and a second contact arm 35 connected to a line 19*b* at the lowering side and being normally on; and a switch control panel 37 which maintains on-operation of the switch 36 at lowering side following the operation of the governor 4 and turns off the switches 33 at the hoisting side during the lowering, and maintains on-operation of the switch 33 at the hoisting side and turns off the switch 36** at the lowering side during the lowering the load.

The governor 4 is provided with an operating disc 27 operable between the forward movement position where the disc 27 forwardly moves thereto due to stop of the motor 3 and the backward movement position where the same backwardly moves thereto, the switch control panel 37 is provided with a fixed substrate and support means which supports the switch control panel in relation of rotating in a predetermined range with respect to the substrate following the rotation of the operating disc 27 and of being movable in reciprocation following the movement of operating disc in reciprocation. On the substrate are juxtaposed a hoisting side switch and a lowering side switch along the rotation direction of the switch control panel. The switch control panel is provided with an engaging member 45 which selectively engages with one of movable side contacts at the hoisting side switch and lowering side switch and which is turned off by rearward movement of the switch control panel following the rearward movement to the backward movement position of the operating disc. Also, it is preferable that between the switch control panel and the substrate is interposed springs for biasing the switch control panel in the direction of backward movement for turning off the movable side contact. The switch control panel 37 is preferably provided with an annular contact surface 44 opposite to the operating disc 27 and contacting therewith at the forward movement position thereof, the annular contact surface 44 being also preferably formed of friction material of, for example, nylon, polyurethane rubber or polypropylene.

The engaging member 45 is provided with a pair of retaining faces 45*a* and 45*b* extending in the opposite and slantwise direction toward the contact arms at movable sides of the hoisting side switch 33 and lowering side switch 36 respectively, and the respective contact arms at the movable sides are preferably provided at the utmost ends with hook-like-shaped retained portions 32*a* and 35*a*.

Furthermore, the switch control panel 37 is supported to a plurality of stays 40 erected from the substrate in relation of being rotatable in the predetermined range and movable in the reciprocation direction of the operating disc 27 at the governor 4, the stays 40 being provided with springs 41 for biasing the switch control panel 37 in the direction of off-operation at the movable side contact arms at the hoisting side and lowering side switches 33 and 36, so that it is preferable that a spring force of the spring 41, provided at the stay 50 erected in the position near the movable side contact arm, when each movable side contact arm is off, has a value to overcome reaction acting in the direction of off-operation.

As mentioned above, the switch control panel 37 for controlling the hoisting side switch 33 and lowering side switch 36 is adapted to maintain on-operation of the lowering side switch 36 and turn off the hoisting side switch 33 following the operation of the governor 4 during the hoisting the load, and to maintain on-operation of the hoisting side switch 33 and turn off the lowering side switch 36 during the lowering operation, whereby in a case where a hoist command is given halfway through the lowering operation, when the normal and reverse rotation switching circuit is switched under this command, the hoisting side switch 33 is on, so that the start capacitor C1 immediately operates to enable the hoist machine to rotate toward the hoisting side. Hence, a minimum lowering operation makes possible the hoisting operation. Hence, the position of the load to be hoisted can quickly set toward the target position.

Also, the governor 4 is provided with the operating disc 27, the switch control panel 37 is supported to the fixed substrate in relation of rotating within the predetermined range following the rotation of the operating disc 27 and of being movable in reciprocation following the reciprocation of the same, the engaging member 45 is provided at the switch control panel 37, and the springs 41 are provided between the switch control panel 37 and the substrate 30, so that the above-mentioned off-operations of the hoisting side switch 33 and lowering side switch 36 by the switch control panel 37 can effectively be executed. Since the switch control panel 37 is provided with the annular contact surface 44 opposite to the operating disc 27 and contacting therewith at the forward movement position, even when the governor 4 causes a backlash, a malfunction of the switch control panel 37 can be avoided, whereby the switch control panel 37 can ensure the switching operation thereof following the operating disc 27 at the governor 4 without malfunction.

When the annular contact surface 44 at the switch control panel 37 is formed of friction material, the switch control panel 37 operable following the governor 4 further can effectively perform its switching operation without malfunction.

The engaging member 45 is provided with the retaining surfaces 45*a* and 45*b*, and the contact arms at the movable side are provided with the hook-like-shaped retained portions 32*b* and 35*b*, whereby even when the motor 3 or the driving member 2 is rotatably driven to cause vibrations the contact arms at the movable sides can effectively be in an off state and maintain the off-operation state. Hence, it can effectively be eliminated that the start capacitor C1 is energized by mistake during the operating the machine.

Furthermore, in such construction that the switch control panel 37 is supported to the plurality of stays 40 and the springs 41 are provided thereon respectively, the spring force of the spring 41 provided at the stay 40 positioned in proximity to the respective contact arms at the movable sides, when the contact arms are off, is set to a value overcoming the reaction acting in the direction of off-operation, so that, when the switch control panel 37 returns at the position of backward movement of the operating disc 27. In other words, when the motor 3 stops to return the operating disc 27 to the backward movement position, the switch control panel 37 can smoothly return in the direction of movement of the hoisting side and lowering side switches 33 and 36 by the operation of each spring 41 in relation of keeping its vertical posture without slant.

These and other objects of the invention will become more apparent in the detailed description and examples which follow.

DETAILED DESCRIPTION OF THE INVENTION

Figure 2:
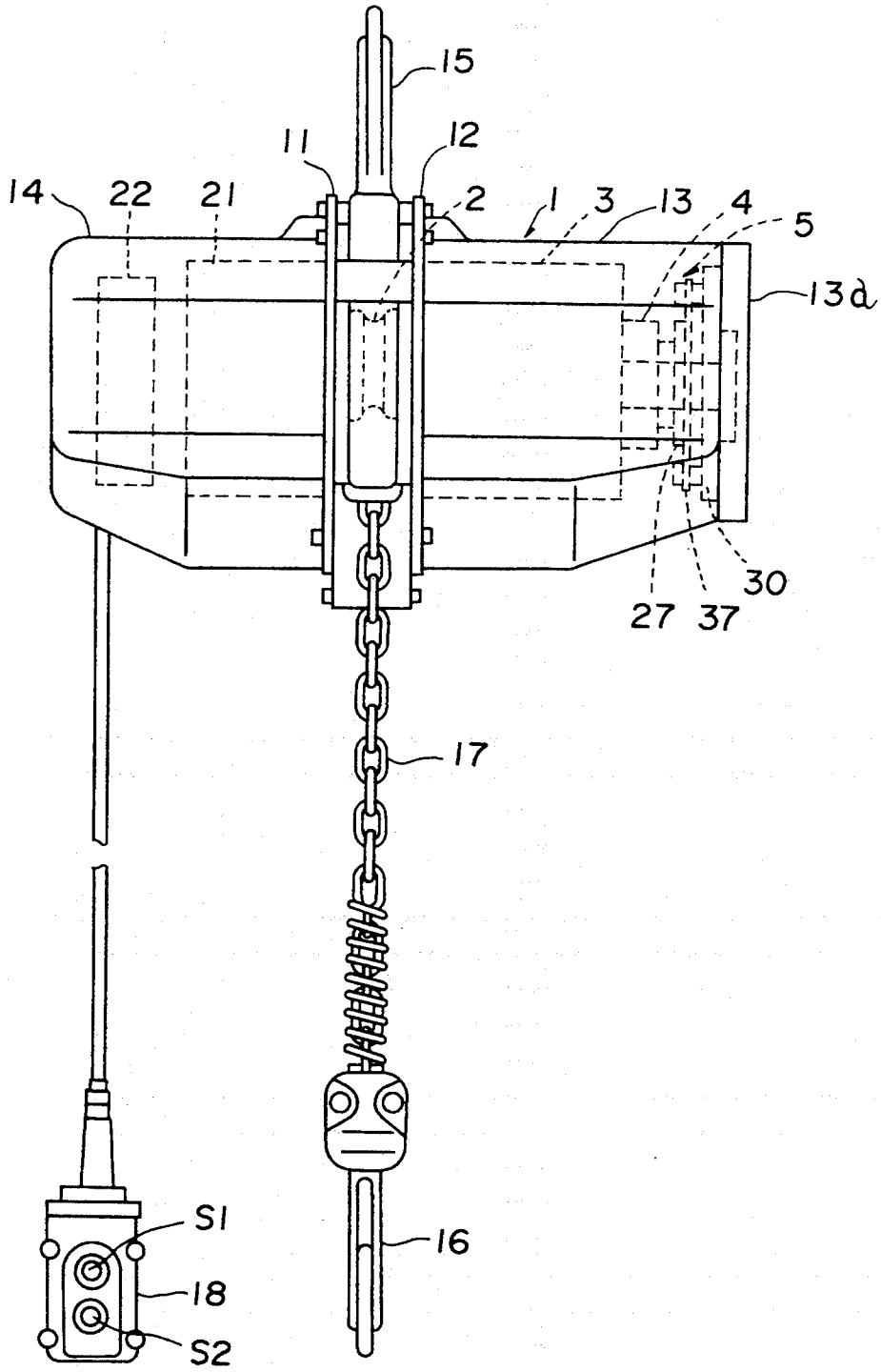
FIG. 2 is a general elevation of an electric motor-drive chain block to which the present invention is applied.

A hoist machine shown in FIG. 2 is an electric motor-driven chain block, which is provided with a chain block body 1 comprising a pair of side plates 11 and 12 disposed opposite to each other and spaced apart at a predetermined interval, and a motor casing 13 and a gear casing 14 which are mounted on both sides of the side plates 11 and 12; rotatably supported between the plates 11 and 12 at the chain block body 1 a driving member 2 comprising a load sheave 2 for hoisting and lowering a load to be hoisted; an upper hook 15 is mounted at the upper side between the side plates 11 and 12, and engages the load sheave 2 with a load chain 17 having a lower hook 16 for hanging the load to be hoisted.

Within the motor casing 13 are interposed, as discussed below, a start capacitor C1, a capacitor start single phase motor 3 having a normal and reverse rotation switching circuit 19 for switching the rotation direction normally or reversely by an external command, a governor 4 mounted to the driving shaft 20 of the motor 3 and operating in response to drive and stop operation of the motor 3, and a switching device 5 for turning on and off the start capacitor C1 following the operation of the governor 4. The gear casing 14 interposes therein a reduction gear mechanism 21 for reducing the drive speed of motor 3 and transmitting it to the load sheave 2 and an electromagnetic brake 22 for braking a transmitting system to the load sheave 2 when a stop command is given to the motor 3.

Figure 3:
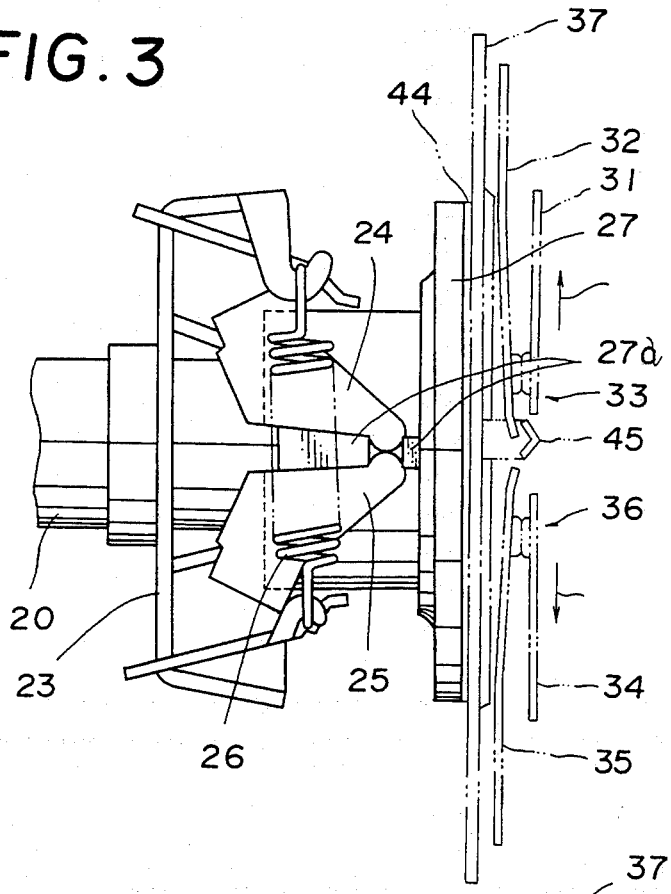
FIG. 3 is an explanatory view of the relation between governor and a switching device.
Figure 4:
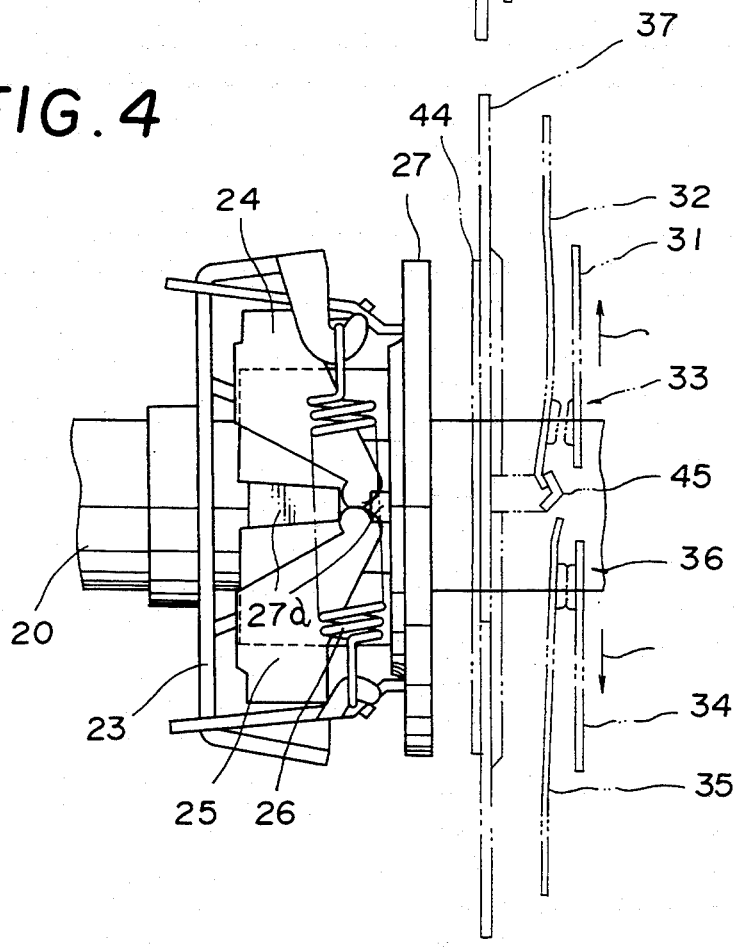
FIG. 4 is an explanatory view of an operating state when the governor operates, corresponding to FIG. 3.

In greater detail, the governor 4, as shown in FIGS. 3 and 4, comprises a support member 23 mounted to the driving shaft 20 of the motor 3 and integrally rotatable with the driving shaft 20, a pair of weights 24 and 25 swingably supported to the support member 23 and subjected to the centrifugal force caused by the rotation of driving shaft 20 so as to swing at the utmost end radially outwardly of the driving shaft 20, a spring 26 interposed between the weights 24 and 25 and for biasing the weights 24 and 25 radially inwardly against the centrifugal force, and an operating disc 27 which is formed mainly of synthetic resin and has an interlocking portion 27*a* for interlocking with the swinging motion of respective weights 24 and 25 so as to interlock with the swinging motion thereof and move in reciprocation axially of the driving shaft 20, the operating disc 27 being adapted to operate by stop and drive operation of the motor 3 and move to a forward movement position in FIG. 3 and a backward movement position shown in FIG. 4.

In detail, when the motor 3 stops, no centrifugal force is generated, whereby the spring 26 acts to radially inwardly swing the weights 24 and 25, so that the operating disc 27 forwardly moves toward the forward movement position shown in FIG. 3. When the motor 3 is driven, the driving shaft 20 rotates thereby and the weights 24 and 25 are subjected to the centrifugal force so as to radially outwardly swing against the spring 26. Therefore, the operating disc 27 rearwardly moves by the swinging motion toward the backward movement position shown in FIG. 4. Thus,the operating disc 27 moves in reciprocation to actuate a switch control panel 37 of a switching device 5 to be discussed below, thereby enabling the switching operation to perform.

Next, explanation will be given on the switching device 5 on the basis of FIGS. 5 through 8.

The switching device 5 comprises a substrate 30 of insulating material mounted on a side plate 13*a* at the motor casing 13, a hoisting side switch 33 comprising a first hoisting side contact arm 31 connected to a hoisting side line 19*a* of a normal and reverse rotation switching circuit 19 of the motor 3 to be discussed below and a second hoisting side contact arm 32 connected to the start capacitor C1 and being normally on, a lowering side switch 36 comprising a first lowering side contact arm 34 connected to a lowering side line 19*b* of the normal and reverse rotation switching circuit 19 and a second lowering side contact arm 35 connected to the start capacitor C1 and being normally on, and the switch control panel 37 which follows movement of the operating disc 27 at the governor 4 to maintain on-operation of the lowering side switch 36 and turn off the hoisting side switch 33 during the hoisting the load and and maintain on-operation of the hoisting side switch 33 and turn off the lowering side switch 36 during the lowering the load.

Figure 8:
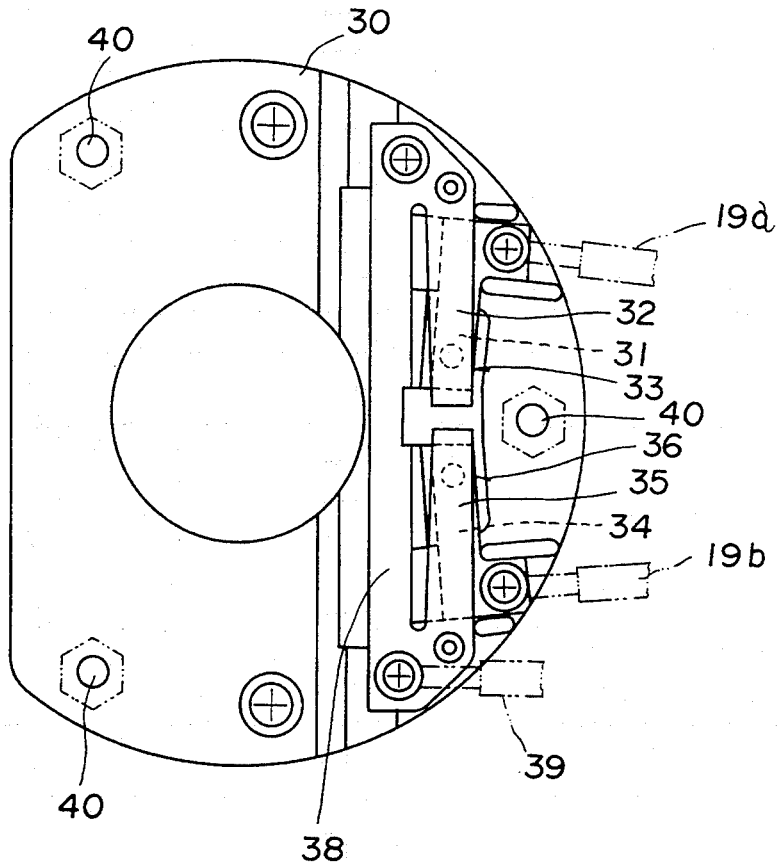
FIG. 8 is a plan view of a substrate only when a switch control panel is omitted from FIG. 5.

In an embodiment of the present invention shown in FIGS. 5 through 8, the first hoisting side contact arm 31 and the first lowering side contact arm 34 at the lowering side are fixed as the fixed contact arms onto the substrate 30 and provided at one ends with stationary contacts 31*a* and 34*a* respectively. The contact arms 31 and 34 are separately connected to the hoisting side line 19*a* and lowering side line 19*b*. The second hoisting side contact arm 32 and the second lowering side contact arm 35 are formed of movable contacts and one ends thereof are mounted onto the substrate 30 and the other ends are formed in free ends and provided with movable contacts 32*a* and 35*a* respectively. As shown in FIG. 8, the second contact arms 32 and 35 are connected at the rears thereof through a connector 38 connected to a connecting line 39 connected to the start capacitor C1.

Figure 5:
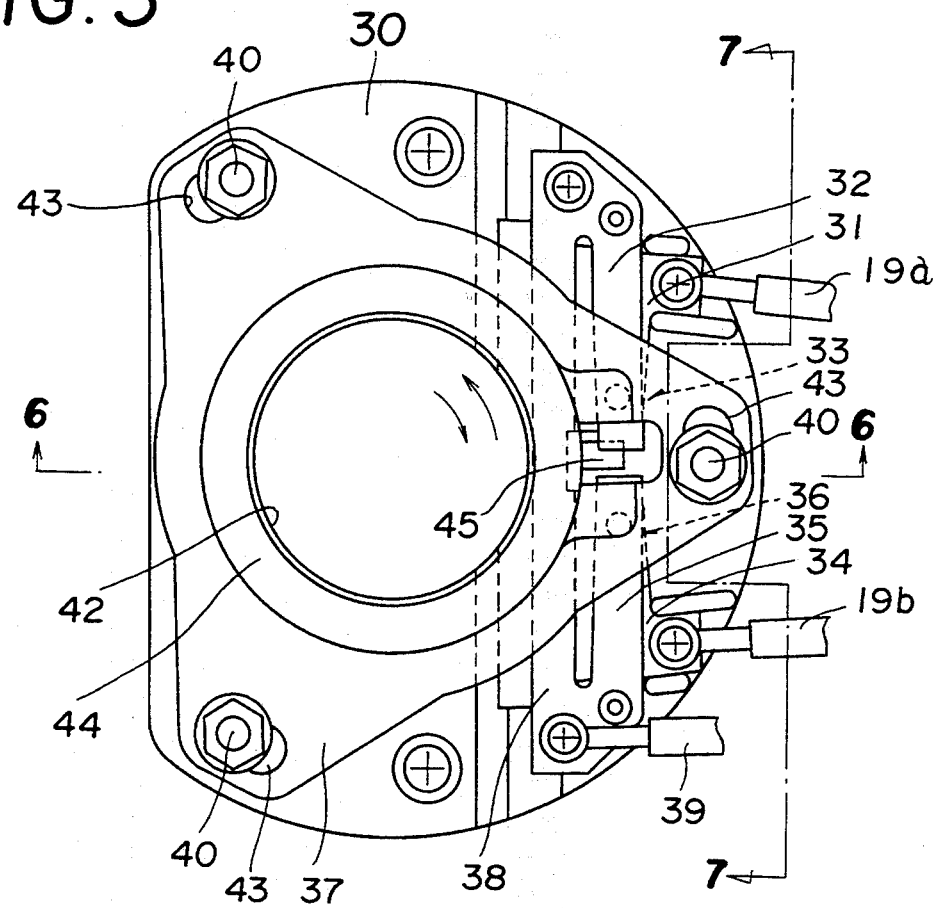
FIG. 5 is a plan view of the switching device.
Figure 6:
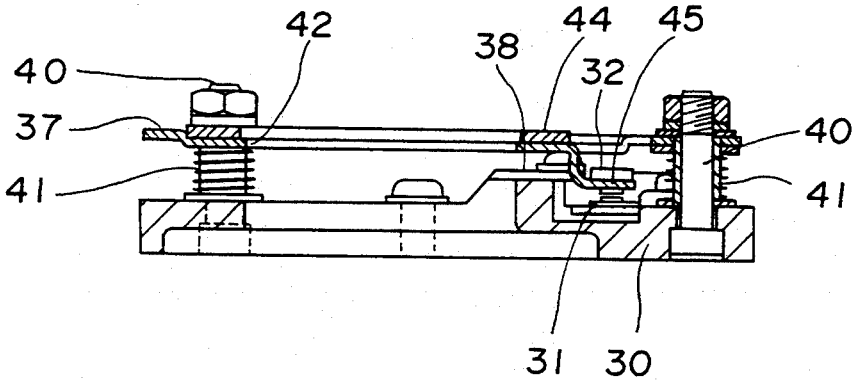
FIG. 6 is a sectional view taken along line 6—6 of FIG. 5.
Figure 7:
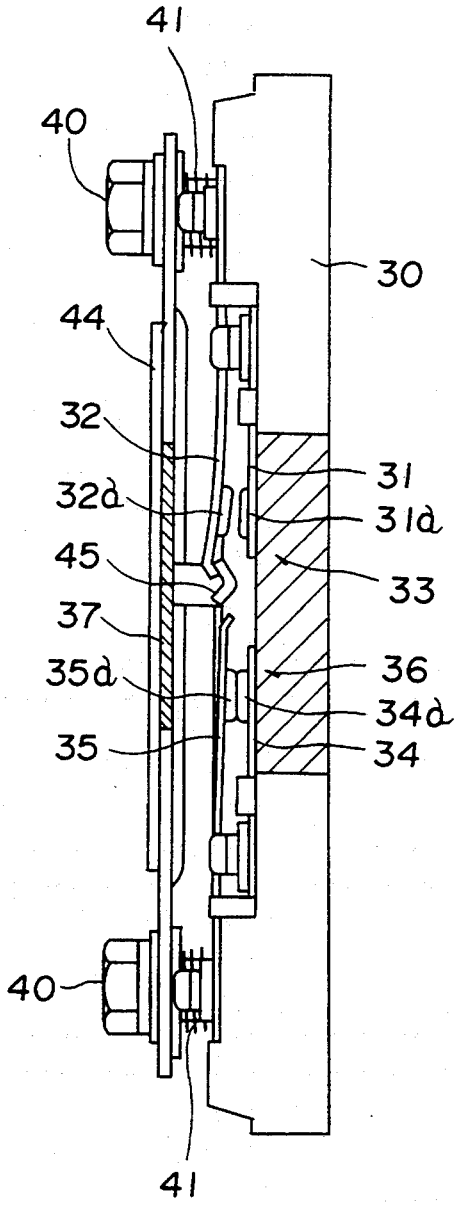
FIG. 7 is an enlarged sectional view taken along line 7—7 of FIG. 5.

In greater detail, the switch control panel 37, as shown in FIGS. 5 and 6, are supported to the stays 40 erected on the substrate 30 in relation of being movable in a predetermined range in the direction of reciprocation of the operating disc 27 and rotatable in a predetermined range in the direction of driving rotation of the motor 3, and onto the respective stays 40 is interposed a spring 41 for biasing the switch control panel 37 in the direction of off-operation of the movable contact arms, that is, the second hoisting side contact arm 32 and the second lowering side contact arm 35.

In other words, the switch control panel 37, as shown in FIG. 5, is formed in an about triangular plane and provided at the center thereof with an insertion bore 42 through which the driving shaft 20 is inserted at the axial end thereof. At the vertex portions of the about triangular shape of the panel 37 are formed slots 43, into which the stays 40 are fitted respectively, and the switch control panel 37 is adapted to be rotatable in the direction of driving rotation of the driving shaft 20 in a range of each slot 43.

On the opposite surface of the switch control panel 37, opposite to the operating disc 27, is formed an annular contact surface 44 which contacts with the operating disc 27 by the movement thereof toward its forward movement position. On the opposite surface of the panel 37, opposite to the movable side contact arms, (i.e., the second contact arms 32 and 35 of the hoisting side and lowering side switches 33 and 36) an engaging member 45 is provided which selectively engages with one of the second contact arms 32 and 35 so as to perform off-operation.

The annular contact surface 44 may be formed directly onto the surface of the switch control panel 37, which surface 44 is preferably formed of friction material, such as, nylon, polyurethane rubber, or polypropylene. The engaging member 45 is formed by cutting and raising part of the switch control panel 37 and integral therewith, which is preferably V-like-shaped in section as enlarged in FIGS. 9 and 10.

Figure 9:
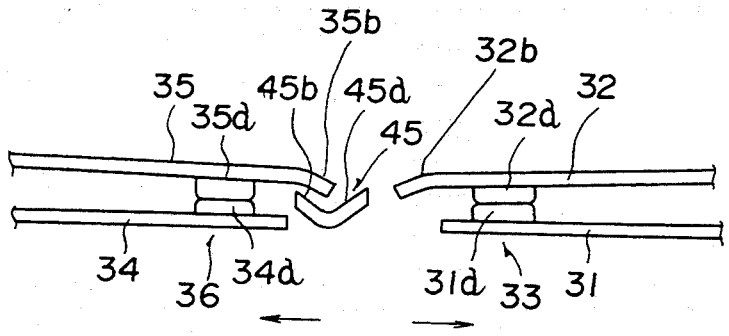
FIG. 9 is an explanatory view of operation of the switching device when a hoisting side switch and a lowering side switch are on, and FIG. 10 is an explanatory view of the switching device when the hoisting side switch is on and the lowering side switch is off during the lowering operation.
Figure 10:
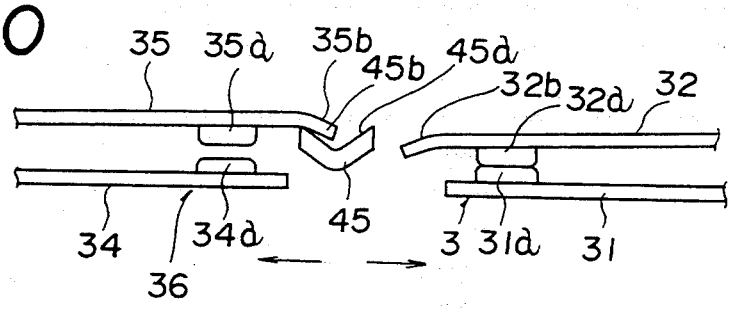

In detail, it is preferable that, a pair of retaining surfaces 45*a* and 45*b* are formed which extend slantwise toward the movable side contact arms. In this case, the movable side contact arms, as shown in FIGS. 9 and 10, are bent at the free ends thereof in the opposite directions with respect to the switch control panel 37, so that, hook-like-shaped retained portions 32*b* and 35*b* opposite to the retaining surfaces 45 and 45*b* are provided respectively.

In the above-mentioned construction, the switch control panel 37, when the operating disc 27 rearwardly moves toward the backward movement position, (i.e., when the driving shaft 20 rotates so that the disc 27 is subjected to the centrifugal force thereof so as to rearwardly moves toward the backward movement position), moves in the backward moving direction of the operating disc 27 due to operation of the spring 41 to thereby turn off one of the second hoisting side contact arm 32 and second lowering side contact arm 35 engageable with the engaging member 45. A spring force of the spring 41 provided at the stay 40 erected at the position in proximity to the second contact arms 32 and 35 is set to a value of spring forces of other springs 41 added with reaction acting in the off-operation direction of each second contact arms 32 and 35, whereby the switch control panel 37 can equally be moved in the backwardly moving direction, in other words, in parallel to the substrate 30, thereby enabling the switch control panel 37 to smoothly move.

Next, explanation will be given of an electric circuit of the motor drive chain block constructed as mentioned above, according to FIG. 1.

To power supply lines L1 and L2 for the motor 3 are connected a hoisting push button switch S1 and a lowering push button switch S2 at a push button operating member 18 through a transformer T1. On connecting lines for the switches S1 and S2 therebetween are interposed electromagnetic contactors K1 and K2 operating in response to the operations of the switches S1 and S2. Also, to the power supply circuits L1 and L2 is connected a normal and reverse rotation switching circuit 19 having switching contacts K11 and K21 for the electromagnetic contactors K1 and K2. For normally or reversely switching the rotation of the motor 3 by operating the switches S1 and S2, the hoisting side switch 33 is connected to the hoisting side line 19*a* at the switching circuit 19, the lowering side switch 36 is connected to the lowering side line 19*b*, and the hoisting side and lowering side lines 19*a* and 19*b* are connected to an auxiliary windings 39 of the motor 3, into which the start capacitor C1 is interposed.

Figure 1:
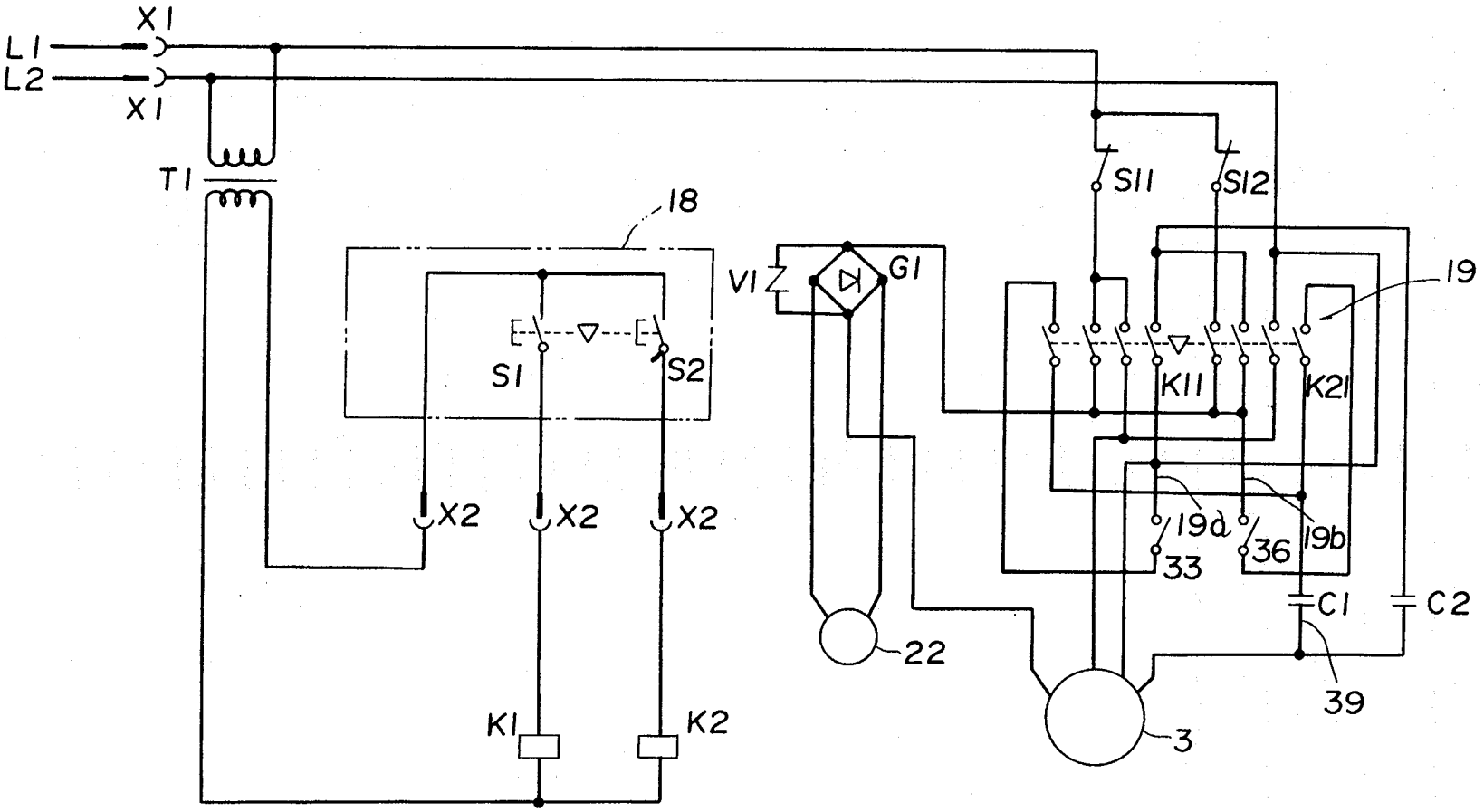
FIG. 1 is an electric circuit diagram showing an embodiment of the present invention.

In addition, reference numeral V1 in FIG. 1 designates a varistor interposed in a circuit of an electromagnetic brake 22 operable when the motor 3 is given a stop command, that is, when both the push button switches S1 and S2 are not operated, and G1 designates a rectifier.

Reference numeral C2 designates a capacitor for run, S11 designates a limit switch for an upper limit interposed in the hoisting line 19*a* and operable by detecting the upper limit of the lower hook 16, S12 designates a lower limit switch interposed in the lowering line 19*b* and operable by detecting the lower limit, and X1 and X2 designates connectors.

Next, explanation will be given of operation of the motor drive chain block constructed as the mentioned above.

At first, in order to hoist from the stationary position a load, such as baggage, retained to the lower hook 16, the hoisting push button switch S1 at the push button operating member 18 is depressed, whereby the electromagnetic contactor K1 is excited, the hoisting switching contact K11 at the normal and reverse rotation switching circuit 19 is on, and the normally closing contact K12 at the electromagnetic contactor K1 is on.

At this time, since the motor 3 is stopped, the weights 24 and 25 at the governor 4 do not operate, the operating disc 27 moves by operation of spring 20 to the forward movement position shown in FIG. 3 and contacts with the annular contact surface 44 at the switch control panel 37, so that the switch control panel 37 is moved in the forwardly moving direction against the spring 41.

As the result, the lowering switches 33 and 36, as shown in FIG. 3, are on, whereby the start capacitor C1 operates to start the motor 3, thereby hoisting the load to be hoisted.

At this time, the switch control panel 37, which contacts with the operating disc 27 by start of the motor 3, follows the rotation of operating disc 27 and rotates in the hoisting direction. The governor 4, when subjected to centrifugal force of driving shaft 20 accompanied by the start of motor 3, operates to move the operating disc 27 rearwardly from the forward movement position shown in FIG. 3 to the backward movement position shown in FIG. 4, whereby the switch control disc 37, as shown in FIG. 4, moves in the backwardly moving direction by operation of the spring 41, at which time, the switch control panel 37 is rotated in the hoisting direction and the engaging member 45 is opposite to the second hoisting side contact arm 32 of the hoisting side switch 33, whereby the switch control panel 37 moves, as mentioned above, to shift the second hoisting side contact arm 32 in the direction of moving away from the first contact arm 31 at the hoisting side and the lowering side switch 36 maintains its on-operation, but the hoisting side switch 33 is off as shown in FIG. 4.

When the driving shaft 20 exceeds a predetermined number of rotations set by the governor 4 after the motor 3 starts, the hoisting side switch 33 is turned off so as to cutoff energization to the start capacitor C1, thereby not creating the problem caused by heating.

Next, when the hoisted load is lowered after being hoisted, the lowering push button switch S2 at the push button operating member 18 is depressed, whereby the electromagnetic contactor K2 is excited and the switching contact K21 at the switching circuit 19 for lowering the load is on. In this case, even when a lowering command is given during the hoisting of the load to be hoisted, as shown in FIG. 4, during the hoisting, the lowering side switch 36 is kept on, so that when the contacts K21 and K22 are on, that is, when the lowering command is given, the start capacitor C1 immediately operates to quickly perform inversion toward the lowering side.

In addition, when the load is lowered from the stationary position, the lowering operation is the same as mentioned above, so that, the switch control panel 37, as shown in FIG. 9, rotates in the lowering direction at the beginning of start operation, and, as shown in FIG. 10, moves in the backwardly moving direction of the operating disc 27 following the operation of governor 4, whereby the second contact arm 35 of the lowering side switch 36 moves away from the first contact arm 34 at the lowering side, thereby turning off the lowering side switch 36.

At this time, the switch control panel 37 rotates in the lowering direction so that the engaging member 45 opposite to the second contact arm 32 at the hoisting side during the hoisting, as shown in FIGS. 9 and 10, shifts to the position opposite to the second contact arm 35 at the lowering side, whereby the second contact arm 32 at the hoisting side moves close to the first contact arm 31 at the hoisting side and the movable contact 32*a* of the second contact arm 32 contacts with the fixed contact 31*a* so that the hoisting side switch 33 is on, thereby maintaining the on-operation thereof during the lowering the load.

Accordingly, even during the lowering of the load, the start capacitor C1 is energized only when starting, so that when the start capacitor C1 exceeds the predetermined number of rotations set by the governor 4 after the start, its energization is cut off.

Also, in a case where the load is hoisted halfway of its lowering, in other words, in order to accurately position the load to be hoisted to a target position, the hoisting and lowering operations may be repeated. Especially, when a hoist command is given halfway of the lowering the load, in the conventional example, even when a hoisting command is given, the motor 3 cannot immediately be inverted to the hoisting side due to rotation of inertia. However, in the present invention, during the load lowering operation, the hoisting side switch 33 maintains its on-operation as shown in FIG. 10, whereby when the hoisting push button switch S1 at the push button operating member 18 is depressed to give a hoist command to turn on the switching contact K11 and normally open contact K12, the start capacitor C1 immediately operates to thereby hoist the load by a minimum quantity of lowering operation.

In the above-mentioned construction, the switch control panel 37 is provided with the annular contact surface 44 opposite to the operating disc 22, which contacts with the contact surface 44 so as to rotate the switch control panel 37 following the operating disc 27, whereby even when the operating disc 27 swings in operation due to a backlash or the like, the switch control panel 37 can always surely operate with less malfunction.

The engaging member 45 at the switch control panel 37 is V-like-shaped in section as the mentioned above, and the hook-like-shaped retaining portions 33*b* and 35*b* are provided at the movable side contact arms, respectively so that even when subjected to vibrations by the motor 3 or an external force, the on-off operation of the respective switches 33 and 36 is not switched, thereby enabling the above-mentioned operation to be performed with accuracy.

In addition, in the above-mentioned embodiment, the first hoisting side contact arm 31 and the first lowering side contact arm 34 connected to the hoisting side line 19*a* and the lowering side line 19*b* are formed in fixed contact arms respectively and the second hoisting side contact arm 32 and the second lowering side contact arm 35 are formed in movable contact arms respectively, which may be formed vice versa.

An example of applying the motor drive chain block which mounts the upper hook 15 at the chain block body 11 is shown above, which may be applied also to the electric trolley, and the hoist machine is not limited to the type thereof.

As seen from the above, in the present invention, the switch control panel 37 for controlling the hoisting side switch 33 and lowering side switch 36 is adapted to maintain on-operation of the lowering side switch 36 following the operation of governor 4 during the lowering of the load so as to turn off the hoisting side switch 33, and to maintain on-operation of the hoisting side switch 33 during the lowering of the load so as to turn off the lowering side switch 36. Hence in a case where the hoisting command is even halfway through the lowering operation, the normal and reverse rotation switching circuit is switched by this command, the hoisting switch 33 is on, so that the start capacitor C1 immediately operates to make possible the rotation toward the hoisting side, whereby the minimum lowering operation enables the hoisting operation and the load to be hoisted can quickly be set in position for the target position.

The governor 4 is provided with the operating disc 27 and the switch control panel 37 is provided with the annular contact surface 44 opposite to the switch control panel 37 and in contact therewith in the forward movement position, whereby even when the governor 4 causes a backlash in operation, the switch control panel 37 avoids malfunction so as to ensure the switching operation thereof following the operating disc 27 at the governor 4 to be performed without a malfunction.

Also, the engaging member 45 is provided with the retaining surfaces 45*a* and 45*b* and the movable side contact arms are provided with the hook-like-shaped portions 32*b* and 35*b* respectively, so that even when the driving rotation of the motor 3 or the driving member 2 causes vibrations, the movable side contacts can be effectively turned off and maintain such an off state, thereby effectively preventing the start capacitor C1 from being energized during the operation.

In a case where the annular contact surface 44 at the switch control panel 37 is formed of friction material, the switching operation of switch control panel 37 operable following the governor 4 can effectively be executed without a malfunction.

Furthermore, in the construction that the switch control panel 37 is supported to a plurality of stays 40 and the springs 41 are provided thereon respectively, the spring force of the spring 41 provided on the stay 40 positioned in proximity to the respective movable side contact arms is set to a value of the spring force of spring 41 on other stays 40 added with reaction acting in the direction of off-operation of the movable side contact arms. Hence, when the switch control panel 37 returns in the backward movement position of the operating disc 27, in other words, when the motor 3 stops to return the operating disc 27 to the backward movement position, the switch control panel 37 can smoothly return in the direction of turning on the hoisting and lowering side switches 33 and 36 by operation of each spring 41 by being kept vertical without a slant with respect to the stays 40.

While a preferred embodiment of the invention has been described using specific terms, such description is for illustrative purpose only, and it is to be understood that the invention is not limited thereto, but may be otherwise variously embodied within the scope of the following claims.

I claim:

1. A hoist machine for hoisting or lowering a load, comprising:

(a) a capacitor start single phase motor having a start capacitor, and a normal and reverse rotation switching circuit, including means for receiving an external command, for selectively switching a rotation direction of the motor between a normal direction in which a load is hoisted and a reverse direction in which the load is lowered in response to said external command;

(b) a driving member which is connected to and is driven by the motor in normal and reverse directions to hoist and lower the load; and (c) a governor, operable in response to drive and stop operation of the motor, rotatable in normal and reverse directions, to govern a switching device which turns on and off the start capacitor in response to operation of the governor, wherein said switching device comprises:

(d-1) a hoisting side switch provided with a first hoisting side contact arm connected to a hoisting side line of the normal and reverse rotation switching circuit of the motor and a second hoisting side contact arm connected to the start capacitor, one of the first and second hoisting side contact arms serving as a fixed side contact arm and the other of the first and second hoisting side serving as a movable side contact arm, the first and second hoisting side contact arms being normally in the on position in which the first and second hoisting side contact arms contact with each other when the motor comes to a stop;

(d-2) a lowering side switch provided with a first lowering side contact arm connected to a lowering side line of the normal and reverse rotation switching circuit of the motor and a second lowering side contact arm connected to the start capacitor, one of the first and second lowering side contact arms serving as a fixed side contact arm, the other of the first and second lowering side contact arms serving as a movable side contact arm, the first and second lowering side contact arms being normally in the on position in which the first and second lowering side contact arms contact with each other when the motor comes to a stop; and (d-3) a switch control panel rotatable, in response to operation of the governor, in a predetermined range in the same rotation directions as that of the governor, and also movable backwards and forwards in an axial direction of the governor, whereby:

when the governor rotates in the normal direction, the switch control panel rotatably moves to an opposing position to the second hoisting side contact arm of the hoisting side switch and also moves axially backwards, so as to cause the second hoisting side contact arm to be moved away from the first hoisting side contact arm and be disconnected therefrom, with on-operation of the lowering side switch being maintained, and when the governor rotates in the reverse direction, the switch control panel rotatably moves to an opposing position to the second lowering side contact arm of the lowering side switch and also moves axially backwards so as to cause the second lowering aide contact arm to be moved away from the first lowering side contact arm and be disconnected therefrom, with on-operation of the hoisting side switch maintained.

2. A hoist machine according to claim 1, wherein the governor comprises:

a support member mounted on a driving shaft of the motor to rotate together with the driving shaft;

weights supported to the support member in such a manner as to be swung radially outwardly of the driving shaft in response to centrifugal force generated by rotation of the driving shaft;

elastic means, interposed between the weights, for biasing the weights radially inwardly against the centrifugal force; and an operating disc adapted to be movable backwards and forwards in an axial direction of the driving shaft in response to the swinging motion of the weights, said operating disc being moved forward when the motor comes to a stop and being moved backwards when the motor is driving, wherein the switching device comprises a substrate fixedly mounted to a motor casing of the motor at a position facing the operating disc, and support means for supporting the switch control panel to be rotated in a predetermined range with respect to the substrate in response to rotation of the operating disc and also to be moved backwards and forwards in response to axial movement of the operating disc, the hoisting side switch and lowering side switch are juxtaposed on the substrate along the rotation direction of the switch control panel, the switch control panel being provided with an engaging member which can be selectively engaged with one of the movable side contact arms of the hoisting side switch and lowering side switch by rotation of the switch control panel and place the one movable side contact arm in the off position by backward movement of the switch control panel responsive to backward movement of the operating disc, and between the switch control panel and the substrate are interposed spring means for biasing the switch control panel in the backward movement direction in which the movable side contact arm is disposed to be turned off.

3. A hoist machine according to claim 2, wherein said switch control panel is provided with an annular contact surface which opposes said operating disc and contacts therewith when said operating disc is forwardly moved.

4. A hoist machine according to claim 3, wherein the annular contact surface of the switch control panel is formed of an elastic friction plate and has a higher coefficient of friction than a contact surface of the operating disc.

5. A hoist machine according to claim 2, wherein said engaging member is provided with a pair of retaining surfaces extending in the oppositely slantwise direction toward said movable side contact arms of said hoisting side switch and lowering side switch, said movable side contact arms being provided at the foremost ends thereof with hook-like-shaped retained portions opposite to said retaining surfaces respectively.

6. A hoist machine according to claim 2, wherein said substrate is provided with a plurality of stays so that said switch control panel is supported to said stays in relation of being rotatable in a predetermined range and movable in reciprocation in the reciprocation direction of said operating disc, said stays are provided with springs for biasing said switch control panel in the reciprocation direction of turning off said movable side contact arms of said hoisting side switch and lowering side switch, and a spring force of a spring among said springs, provided at the position in proximity to said movable side contact arm is of a value overcoming reaction acting in the direction of off-operation of said movable side contact arm when said switch control panel backwardly moves to turn off said movable side contact arm.

* * * * *